US006131310A

United States Patent [19]

Fang

[11] Patent Number: 6,131,310

[45] Date of Patent: Oct. 17, 2000

[54] OUTSOLE HAVING A CUSHION CHAMBER

[76] Inventor: Wen-Tsung Fang, No. 142, Wen Hua Street, Taichung, Taiwan

[21] Appl. No.: 09/472,474

[22] Filed: Dec. 27, 1999

[51] Int. Cl.[7] ..... A43B 13/18

[52] U.S. Cl. ..... 36/28; 36/29

[58] Field of Search ..... 36/29, 3 B, 141, 36/28, 35 B, 35 R, 37

[56] References Cited

U.S. PATENT DOCUMENTS

| | | | |
|---|---|---|---|
| 1,476,690 | 12/1923 | Cohn | 36/28 |
| 5,220,737 | 6/1993 | Edington | 36/28 |
| 5,918,383 | 7/1999 | Chee | 36/28 |

*Primary Examiner*—Paul T. Sewell
*Assistant Examiner*—Troy Arnold
*Attorney, Agent, or Firm*—Charles E. Baxley, Esq.

[57] ABSTRACT

An outsole for footwear includes a base member having a first flange extending from a periphery of the base member, and a second flange extending from a top surface of the base member. A peripheral groove is defined between the first flange and the second flange. A plurality of separating posts extend from the top surface of the base member and a midsole is mounted to the base member. The midsole has a skirt extending from a periphery thereof and the skirt is engaged with the peripheral groove of the base. The midsole is supported on the second flange so that a cushion chamber is defined between the midsole, the top surface of the base and the second flange.

5 Claims, 5 Drawing Sheets

OUTSOLE HAVING A CUSHION CHAMBER

FIELD OF THE INVENTION

The present invention relates to an outsole of footwear wherein the outsole has a peripheral groove for a top member engaged with the groove, and a cushion chamber defined between the top member and the outsole. The cushion chamber is located all over the outsole.

BACKGROUND OF THE INVENTION

A conventional outsole 10 for footwear is shown in FIG. 6 and generally includes a bottom with a lots of patterns so as to provide better friction feature, and a top surface from which a plurality of ribs 11 extend. These ribs 11 are arranged as many cruciform patterns so as to enclose many chambers 12. A midsole (not shown) is connected to the ribs 11. The chambers 12 are supposed to provide a cushion feature so that the wearers feel comfortable when walking or running. Nevertheless, the desired feature is difficult to achieve, because the ribs 11 are made of material that is not so flexible and/or soft so that they can only deform slightly and the desired cushion feature is reduced. Although some types of light and soft material is developed, they are expensive. Furthermore, the conventional outsole is a solid member so that it is heavy. In order to have a better bounce feature, some new and expensive outsoles have a plurality of air cells are located at the heel portion. These types of outsoles involve many complicated processes and the air cells are only located at a limited area of the outsole such as the heel portion.

The present invention intends to provide an outsole that has a plurality of longer supporting posts and shorter separating rods extending from a top of the outsole. A midsole is connected to the top of the outsole and supported on the support posts. A cushion chamber is defined between the top member, the supporting posts and the top of the outsole, the cushion chamber located all over the outsole.

SUMMARY OF THE INVENTION

In accordance with one aspect of the present invention, there is provided an outsole for footwear and comprising a base member having two flanges extending from a periphery of the base member so as to define a peripheral groove betwen the two flanges. A midsole is mounted to the base member and supported by an inner flange of the base member. The midsole has a skirt which is engaged with the peripheral groove of the base. A cushion chamber is defined between the midsole, the top surface of the base and the inner flange.

The object of the present invention is to provide an outsole that has a cushion chamber located all over the entire outsole.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
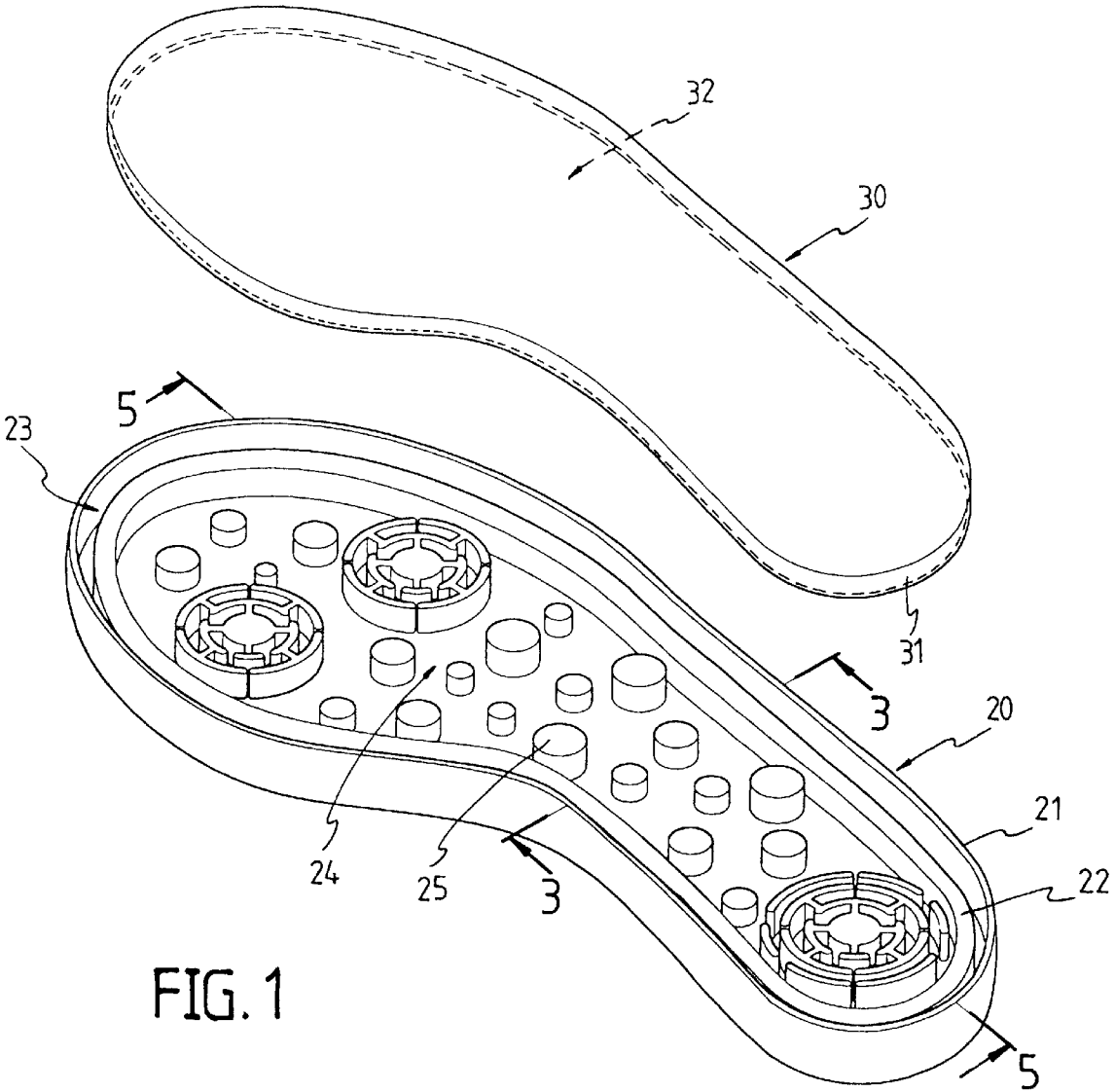
FIG. 1 is an exploded view to show the outsole in accordance with the present invention.
Figure 2:
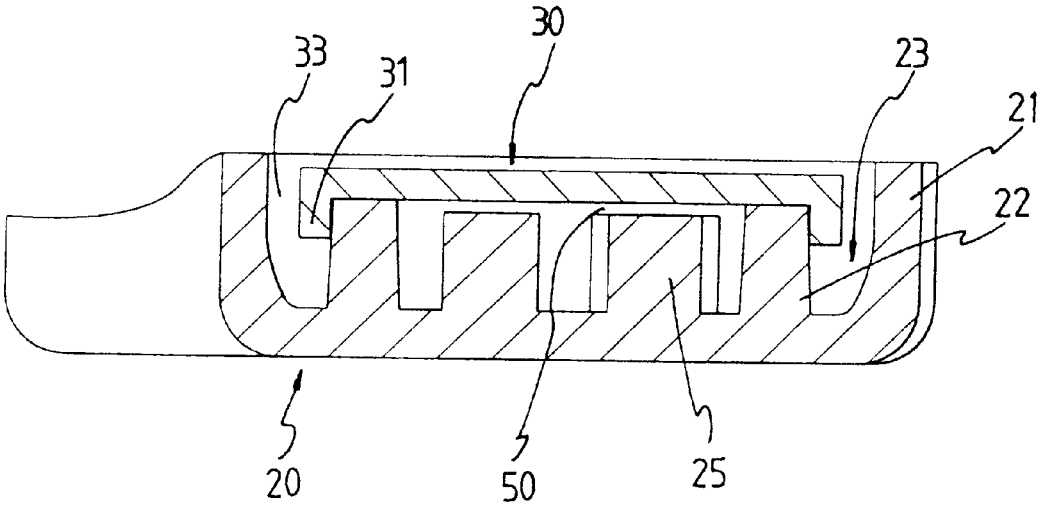
FIG. 2 is a cross-sectional view to show the top member that is supported on the second flange of the base member.

Referring to FIGS. 1 to 4, the outsole in accordance with the present invention comprises a base member 20 having a first flange 21 extending from a periphery of the base member 20 and a second flange 22 extends from a top surface 24 of the base member 20 so that a peripheral groove 23 is defined between the first flange 22 and the second flange 21. A plurality of separating posts 25 extend from the top surface 24 of the base member 20, wherein the second flange 22 is longer than the separating posts 25.

Figure 3:
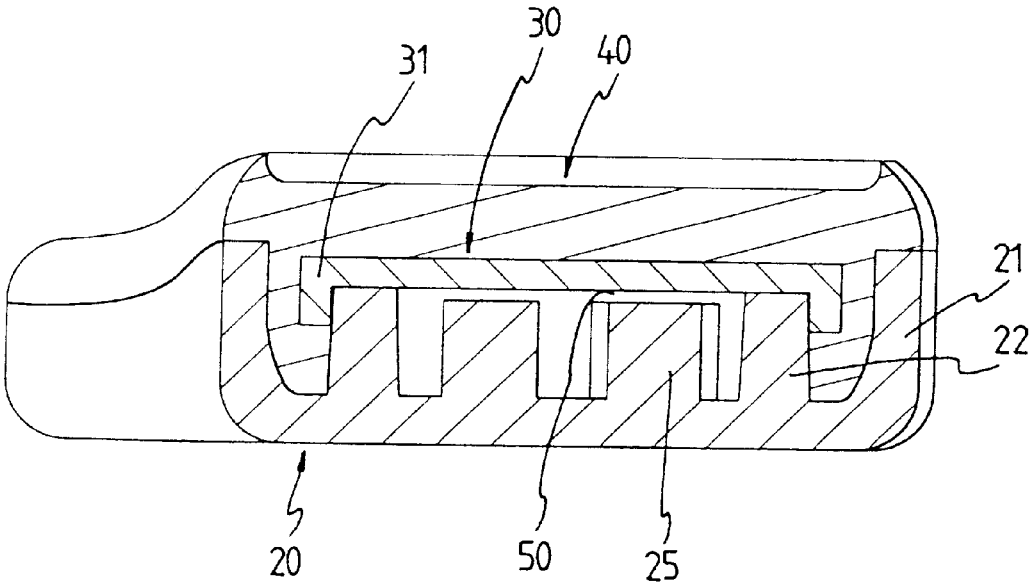
FIG. 3 is a cross-sectional view to show the cover member that is mounted to the top member and seals the peripheral groove of the base member of the present invention.

A midsole is engaged with the base member 20 and includes a top member 30 and a cover member 40. The top member 30 has an engaging flange 31 extending from a periphery thereof and the engaging flange 31 is engaged with the peripheral groove 23 of the base 20 and contacts an outside of the second flange 22. It is to be noted that when the top member 30 is engaged with the periphery groove 23, the top member 30 is supported on the second flange 22 and a gap 50 is defined between each separating post 25 and the top member 30. The engaging flange 31 is thinner than a width of the peripheral groove 23 so that a gap 33 is defined between an inside of the first flange 21 and the engaging flange 31. The cover member 40 is mounted to the top member 30 and seals the gap 33 as shown in FIG. 3. In other words, the midsole has a skirt that is composed of the engaging flange 31 and the peripheral portion of the cover member 40. The material of the peripheral portion of the cover member 40 fills and seals the gap 33.

Figure 4:
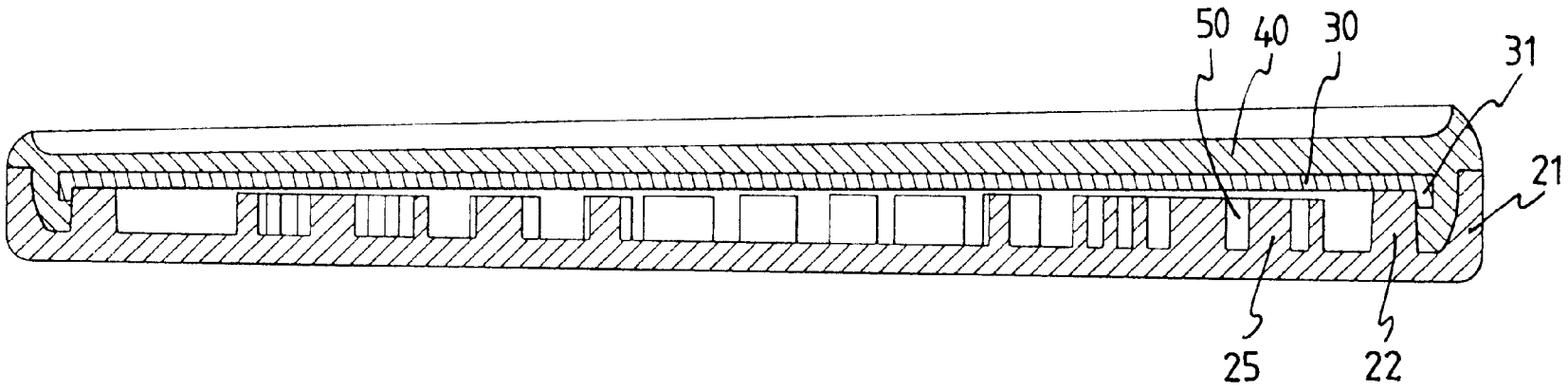
FIG. 4 is a side elevational view of the outsole of the present invention.
Figure 5:
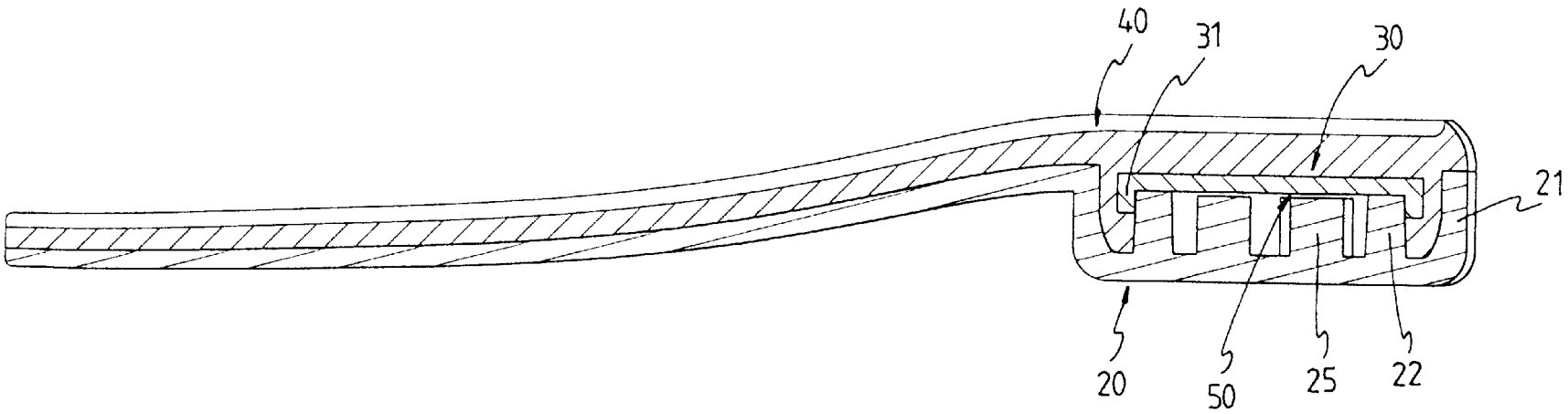
FIG. 5 is a side elevational view to show the outsole of the present invention that is used at the heel portion of footwear.
Figure 6:
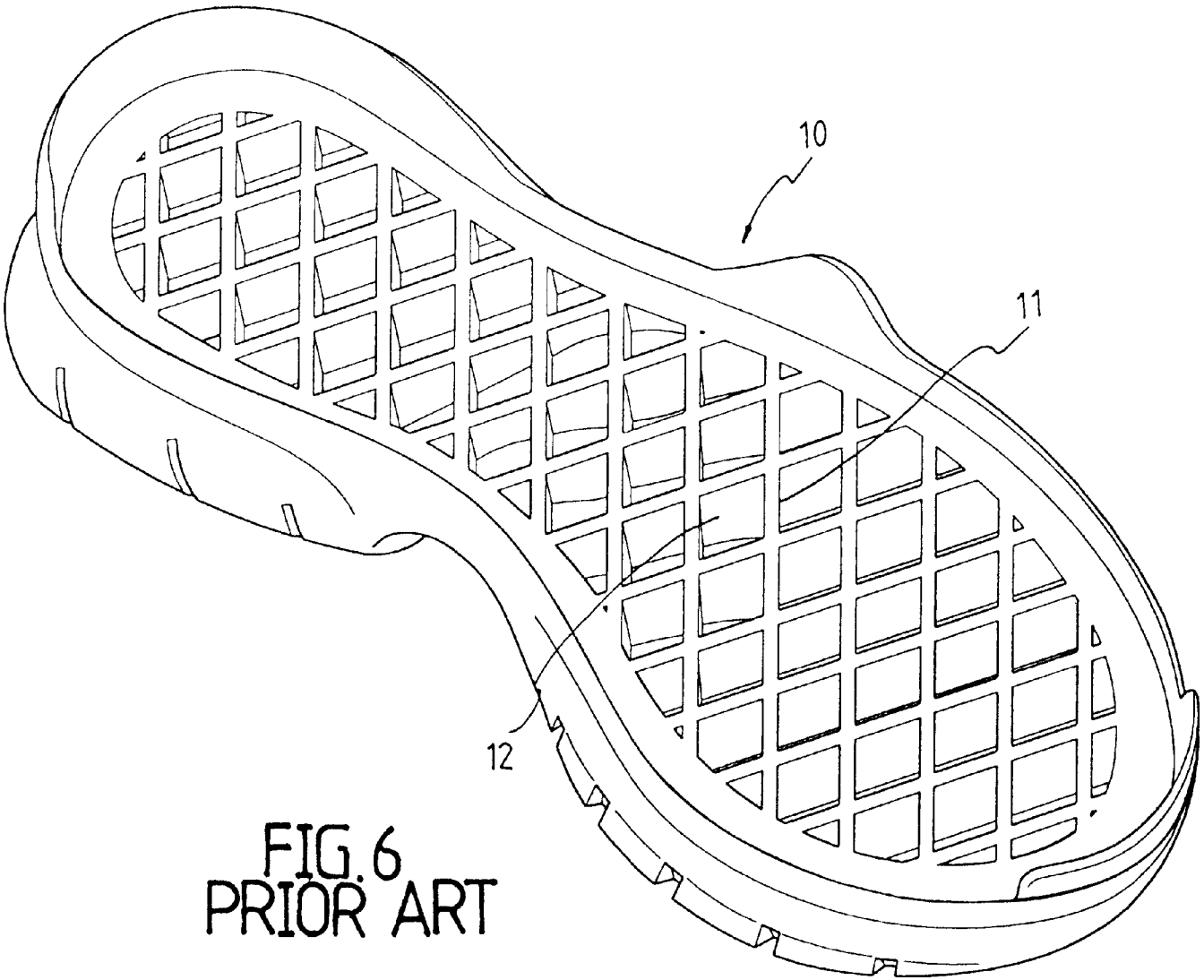
FIG. 6 PRIOR ART
FIG. 6 is a perspective view to show a conventional outsole.

A cushion chamber is then defined between the midsole, the top surface of the base 20 and the second flange 22. The location and/or area of the cushion chamber of the outsole can be conveniently decided to include the entire outsole as shown in FIG. 4. FIG. 5 shows that the cushion chamber can be located only at the heel portion of the outsole. The separating posts 25 provide a proper support when the midsole is stepped downward by a large force.

The number of the separating posts 25 and the location of the separating posts 25 can be decided according to the practical needs. The weight of the outsole of the present invention is light and the whole outsole equipped with air cushion.

While we have shown and described various embodiments in accordance with the present invention, it should be clear to those skilled in the art that further embodiments may be made without departing from the scope and spirit of the present invention.

What is claimed is:

1. An outsole for footwear, comprising:

a base member having a first flange extending from a periphery of said base member, a second flange extending from a top surface of said base member and a peripheral groove defined between said first flange and said second flange, and a midsole having a skirt extending from a periphery thereof and said skirt engaged with said peripheral groove of said base, said midsole supported on said second flange, a cushion chamber defined between said midsole, said top surface of said base and the second flange.

2. The outsole as claimed in claim 1, further comprising a plurality of separating posts extending from said top surface of said base member, said second flange being longer than said separating posts.

3. The outsole as claimed in claim 1, wherein said midsole includes a top member and a cover member, said top member having an engaged flange extending from a periphery thereof and said engaging flange engaged with an outside of said second flange of said base so that said top member is supported on said second flange, said engaging flange being thinner than a width of said peripheral groove, said cover member mounted to said top member and sealing said peripheral groove.

4. The outsole as claimed in claim 3, wherein said cover member has a peripheral portion which is filled in said peripheral groove.

5. The outsole as claimed in claim 1, further comprising a gap defined between said top member and each separating post.

* * * * *